United States Patent [19]

Bowers et al.

[11] Patent Number: 4,752,302

[45] Date of Patent: Jun. 21, 1988

[54] METHOD AND COMPOSITION FOR IMPROVING FLAME COMBUSTION OF LIQUID CARBONACEOUS FUELS

[75] Inventors: Wayne E. Bowers, Clearwater, Fla.; Barry N. Sprague, West Haven, Conn.

[73] Assignee: Fuel Tech, Inc., Stamford, Conn.

[21] Appl. No.: 874,506

[22] Filed: Jun. 16, 1986

Related U.S. Application Data

[63] Continuation-in-part of Ser. No. 774,326, Sep. 10, 1985, abandoned.

[51] Int. Cl.[4] ..... C10L 1/12

[52] U.S. Cl. ..... 44/68; 44/67; 44/51; 431/4; 110/342; 110/343

[58] Field of Search ..... 44/51, 68, 67; 431/4; 110/342, 343; 774/326

[56] References Cited

U.S. PATENT DOCUMENTS

| | | | |
|---|---|---|---|
| 2,439,897 | 4/1948 | La Chapelle | 44/51 |
| 2,579,257 | 12/1951 | Hansley et al. | 44/51 |
| 2,843,200 | 7/1958 | Rocchini | 44/68 |
| 2,890,108 | 6/1959 | Toulmin, Jr. | 44/68 |
| 2,927,849 | 3/1960 | Greblick et al. | 44/51 |
| 2,986,456 | 5/1961 | Toulmin, Jr. | 44/68 |
| 3,111,381 | 11/1963 | Panzer et al. | 44/51 |
| 3,941,552 | 3/1976 | Cottell | 431/4 |
| 3,965,829 | 6/1976 | Lees | 110/342 |

*Primary Examiner*—William R. Dixon, Jr.
*Assistant Examiner*—Ellen McAvoy
*Attorney, Agent, or Firm*—Thaddius J. Carvis

[57] ABSTRACT

The present invention improves flame combustion of liquid carbonaceous fuels by the preparation and use of a fuel additive comprising a finely-divided particulate hydrated compound in stable suspension in a liquid vehicle. The median major dimension of the primary particles of hydrated compound is preferably less than 10 microns. When employed at a level of from about 200 to about 5000 parts per million, the additive can improve the efficiency of combustion and reduce particulate emissions for flame combustion of liquid carbonaceous fuels, especially residual grades of fuel oil.

23 Claims, No Drawings

METHOD AND COMPOSITION FOR IMPROVING FLAME COMBUSTION OF LIQUID CARBONACEOUS FUELS

RELATED APPLICATIONS

This application is a continuation-in-part of copending U.S. Ser. No. 774,326, filed Sept. 10, 1985, now abandoned.

TECHNICAL FIELD

The present invention relates to flame combustion of liquid carbonaceous fuels, and more particularly to additives including finely-divided particulate materials which enhance such combustion.

Flame combustion of fuel oil, particularly heavier fractions including bunker or like grades employed to fire large boilers of the type employed by utilities, factories and large buildings, has been a subject of considerable study. The amounts of heat, money and emissions involved in such operations are staggering. A clear opportunity exists for improving cost effectiveness in firing such boilers.

The heavier grades of fuel oil, e.g. grades 4–6, are both less expensive and higher in heating capacity than the lighter distillate grades. Unfortunately, the high viscosity of these oils prevents the degree of mixing of air and oil necessary to obtain optimum combustion. This results not only in lost heating value, but the production of excessive particulate emissions. Additives and process improvements have been developed which partially answer these concerns; however, there remains a present need for yet further improvement.

BACKGROUND ART

The prior art has suggested adding combustion improvers for diverse types of fuel usages including flame burners, diesel engines, gasoline internal combustion engines and various turbine configurations. Each type of combustion apparatus has its unique characteristics in terms of supply, oxygenation, combustion and exhaust, and additives have largely been designed to meet specific needs. The prior art has employed a variety of additives, some in liquid form, some with liquid carriers, and some solid, as the particular needs of the combustion system and its interaction with the additive has required. The following citations are representative of the diversity of additives, physical forms and conditions of use.

U.S. Pat. No. 2,843,200 to Rocchini, is concerned with reducing the corrosiveness of vanadium compounds in fuels. Rocchini discloses adding finely-divided precipitated hydrated calcium silicates where vanadium corrosion is a problem. The level of addition is based on the vanadium content of the fuel. The calcium silicates are said to change the nature of the resulting vanadium-containing ash but are not disclosed as improving combustion per se.

U.S. Pat. No. 2,402,427 to Miller et al discloses treatment of fuels for diesel engines to increase their cetane numbers—thus improving engine performance. This is done by contacting the diesel fuel with a solid ignition promoter just prior to use, to dissolve relatively small amounts of the solid in the fuel. The ignition promoter is preferably heated prior to contact with the fuel to assure achievement of the desired concentration in solution, and any undissolved solid particles of ignition promoter are screened from the fuel prior to injection into the engine.

In U.S. Pat. No. 4,129,421, Webb discloses a catalytic fuel additive for use in engines or furnaces. The additive employs a solution of picric acid and ferrous sulfate in specified alcohols. An example shows the additive employed for use in gasoline engines at levels supplying less than 10 parts per billion of the combined catalysts. The disclosure indicates higher but unspecified levels of use for heavy fuel oils. In all cases the catalysts are fully dissolved in the fuel.

In commonly assigned EPO patent application No. 119,086A, filed by Osgerby, there is described a system for the continuous introduction of an admixture of a fluid and a catalytic material, such as a salt of a platinum group metal, directly into a combustion chamber. The catalytic material is selected so that the catalyst (e.g., metallic platinum) will rapidly be made available by the heat of combustion to enhance that combustion. Catalyst-containing materials such as chloro platinic acid ($H_2PtCl_6.H_2O$), platinum tetrachloride ($PtCl_4$), ruthenium chloride ($RuCl_3.H_2O$), ruthenium oxide ($RuO_2.H_2O$), palladium nitrate ($Pd(NO_3)_2$), palladium sulfate ($PdSO_4.2H_2O$), rhodium nitrate ($Rh(NO_3)_3.2H_2O$), magnesium oxide (MgO) and manganese oxide (MnO) are disclosed as exemplary. When steam or water is employed as the fluid for admixture with the catalyst materials, exposure to the flame causes microexplosions of the water as it rapidly expands upon heating. These microexplosions shatter the oil droplets, yet further improving the combustion.

In U.S. Ser. No. 516,094, filed July 22, 1983 by Haney and Sullivan, also commonly assigned, a stable emulsion is prepared containing fuel and a dispersed phase which includes a catalyst material, preferably as part of a liquid medium. The catalysts exemplified here are of the type disclosed in the EPO application mentioned above. Rapid transformation of the dispersed liquid to the gas phase was disclosed to cause microexplosions which enhance combustion.

And, in commonly assigned U.S. Ser. No. 677,954, filed Dec. 4, 1984 by Bowers and Sprague, there is described a method for improving combustion which employs catalyst compounds which are soluble directly in the fuel and eliminates the need for aqueous or other carriers as well as for high-shear dispersing and emulsifying equipment and processing.

In U.S. Pat. No. 3,765,848, Brent discloses the addition of sodium tripolyphosphate in powdered form to a liquid hydrocarbon motor fuel to improve combustion. Brent suggests that there may be some interaction of the additive with the water which is always present to some extent in gasoline. At a concentration of about 10 PPM, the compound is said to promote cleaner and more complete combustion with no accumulation in carburators.

In U.S. Pat. No. 3,332,755, Kukin discloses combustion-improving additives for residual petroleum fuel, coal, coke, and fuel containing vanadium, sulfur or sodium. The disclosure noted that the prior art had injected into the firing zone comparatively massive dosages of materials such as the oxides, hydroxides, carbonates and other salts of magnesium, calcium, aluminum, zinc, sodium, silicon, manganese and various of the rare earth metals, as well as clays such as dolomite, talc, and magnesias. Noting that these additives had proved unsatisfactory because the large doses required would produce appreciable quantities of dense, tenacious ash, and cause other difficulties, there is disclosed an additive which contains low levels of iron and any two of aluminum, magnesium and manganese. The examples show additives containing iron as iron oxide, magnesium as the hydroxide ($Mg(OH)_2$), manganese as manganese dioxide ($MnO_2$) and aluminum as aluminum hydroxide ($Al(OH)_3$), with these active materials dispersed in liquid containing an oil phase, surfactant, water, hydrophilic colloid, a glycol and pigment stabilizer. Where the additive is to employ relatively high percentages of aluminum, it is preferred that such be added as calcined alumina or a mixture of hydroxide (commonly referred to as hydrate) and calcined alumina. The active materials are preferably present in the liquid at particle sizes of from 0.1 to 10 microns and the disclosure exemplifies one additive, including the vehicle (about 50%) and combination of three essential metals, added to residual petroleum fuel in proportions of 0.035% by weight of the fuel.

DISCLOSURE OF THE INVENTION

While the prior art has endeavored to realize improved combustion through the use of various additives, some dissolved and some in solid form, there has been no use or recognition in the prior art of solid additives which by the nature of their chemistry, physical form and level of usage enhance flame combustion by better atomization of a fuel for admixture with and burning in air within a flame zone.

The present invention provides a fuel additive, a fuel as improved with the additive, and methods of preparing both the additive and fuel as well as for improving combustion through their use.

The additive will comprise a dispersion in a liquid vehicle of finely-divided hydrated compound. The hydrated compound preferably has a low solubility in the vehicle and the intended fuel. The hydrated compound should be capable of rapidly evolving its water of hydration at a temperature above ambient and below the flame temperature of the fuel in a type of burner for which it is intended. The additive is preferably prepared by mixing a suitable solid hydrated compound with a suitable liquid vehicle and grinding the compound therein to achieve a stable dispersion. The solid hydrated compound is preferably reduced to primary particles having a median major dimension of less than about 10 microns and preferably is substantially free of aggregates. The additive is admixed with fuel in an amount of from about 50 to about 5000 parts per million (PPM) to provide a fuel with improved combustion properties, which burns with less carbonaceous particulate emissions.

A major advantage of the additive of the invention is that it improves the dispersion of air (or other oxidizer) with fuel in the combustion zone by creating a rapid evolution of gaseous water from a solid hydrate at a great number of well-distributed points within individual atomized droplets of liquid fuel to cause them to shatter. This shattering of the droplets not only further reduces the size of the individual fuel droplets, increasing the chance that they will be completely burned within the time and at the temperature held within the flame zone of the burner, but also improves the distribution of oxygen and fuel to yet further enhance chances for more complete combustion. These enhancements are provided by the selection of suitable physical forms of hydrated compounds which are capable of providing this shattering action under conditions of combustion.

A wide range of hydrated chemical compounds can be employed according to the present invention. The materials should have limited solubility in the fuel to assure that sufficient solid particulate material is present within the fuel upon feeding to a combustion zone. Preferably, the hydrated compounds will have solubilities in the fuel of less than about 10%, and most preferably less than about 1%.

It is also important that the hydrated compound be sufficiently stable in its hydrated form to survive grinding, as will be described below, normal commercial distribution and handling, and preheating of the fuel where required, but yet be capable of rapidly evolving its water of hydration once injected into the combustion zone of a burner, typically operated at a temperature of from 1350° to 1750° C. Preferably, the hydrated compounds will be stable within a temperature range of up to from about 150° C. to about 250° C. so that it will be capable of withstanding preheating when admixed with a fuel oil which requires preheating, yet will quickly release its water of hydration in the combustion zone. In this regard it is noted that number 6 fuel oil (Bunker C) should be preheated to a temperature of from about 100° to about 130° C. to reduce its viscosity prior to atomization.

Among the suitable hydrated compounds are the various industrial grades of pure compounds as well as hydrated minerals. These materials may be employed alone on in combination. Representative hydrated compounds are listed below:

| | | |
|---|---|---|
| | I. PURE COMPOUNDS | |
| a. | Aluminum | $Al_2(SO_4)_3.18H_2O$ |
| | | $NH_4Al(SO_4)_2.12H_2O$ |
| b. | Cobalt | $Co(C_2H_3O_2)_2.4H_2O$ |
| | | $CoCl_2.6H_2O$ |
| | | $CoPtCl_6.6H_2O$ |
| c. | Iron | $Fe(C_2H_3O_2)_2.4H_2O$ |
| | | $FeCl_3.6H_2O$ |
| | | $Fe(NO_3)_2.9H_2O$ |
| | | $(Fe)_4(P_2O_7)_3.9H_2O$ |
| | | $Fe_2(SO_4)_3.9H_2O$ |
| d. | Manganese | $Mn(C_2H_3O_2)_2.4H_2O$ |
| | | $Mn(NO_3)_2.4H_2O$ |
| | | $MnSO_4.7H_2O$ |
| e. | Magnesium | $Mg(NO_3)_2.6H_2O$ |
| | | $Mg_3(PO_4)_2.8H_2O$ |
| | | $MgSO_4.7H_2O$ |
| | | $MgPdCl_6.6H_2O$ |
| | | $MgPtCl_6.6H_2O$ |
| f. | Platinum | $H_2PtCl_6.6H_2O$ |
| | II. MINERALS | |
| a. | Vermiculite | Hydrated Mg, Al, Fe, silicate |
| b. | Bieberite | $CoSO_4.7H_2O$ |
| c. | Boussingaulite | $(NH_4)_2Mg(SO_4)_2.6H_2O$ |
| d. | Epsomite | $MgSO_4.7H_2O$ |
| e. | Gaunite | $NH_4MgPO_4.6H_2O$ |
| f. | Artinite | $MgCO_3.Mg(OH)_2.3H_2O$ |

The preferred compounds among those listed above and the other suitable materials, are those which result in minimal combustion residues especially as regards residues corrosive to equipment or surroundings. The preferred compounds will thus be those including transition and alkaline earth metals. Most preferred among these are those containing Mg, Al, Pt or Fe as the metal component. The preferred anion components of the compounds are nitrates, acetates, sulfates or silicates.

Another factor of importance to the selection of suitable hydrates is the ability to most rapidly, under conditions within the combustion chamber, give off the greatest amounts of gaseous water within the time period during which the atomization enhancement provided by the invention can have the greatest effect. Preferably, the hydrated compound will release its water of hydration at a temperature below about 500° C. Most of the inorganic hydrates yield their water of hydration sufficiently rapidly that a principal factor becomes the relative amount of water which is bound and capable of release. In this regard, it is noted that magnesium nitrate hexahydrate ($MgNO_3)_2.6H_2O$) and magnesium nitrate heptahydrate ($Mg(NO_3)_2.7H_2O$) are particularly desirable materials with weight ratios of bound water to total compound weight of 1:2.37 and 1:2.17, respectively. More broadly, ratios of greater than about 1:10, and preferably greater than about 1.6, will be effective. More preferred ratios of bound water to compound weight are those greater than 1:5, more preferably greater than 1:4, and most preferably greater than 1:3.

While not essential to the operability of the present invention, the hydrated compound can contain a metal which, upon release under the heat within the combustion chamber, catalyzes the combustion reaction. Typical of such metals are those of the platinum group and specifically those compounds set forth above in relation to the disclosures of the noted copending commonly assigned patent applications. Where desired, any of those materials can be added to the hydrated compounds of the present invention in the amounts disclosed in those applications as effective. Alternatively, the hydrated catalysts disclosed therein, such as chloroplatinic acid, ruthenium chloride, ruthenium oxide, palladium sulfate and rhodium nitrate, can be added as a portion of the hydrated material required according to the present invention without an excess of water. It is also possible to incorporate such catalysts in other ways.

In order to achieve the desired enhancement of atomization of liquid carbonaceous fuel within the combustion chamber, it is necessary to obtain an even distribution of finely divided hydrated compound within the fuel. This can be achieved by admixing the solid hydrated compound with a suitable liquid vehicle which is miscible in the intended liquid carbonaceous fuel, grinding the hydrated compound in the presence of the vehicle to form a stable suspension of the solid in the vehicle. The suspension can then be uniformly blended with an intended fuel.

The liquid vehicles of preference are those which are completely miscible with the intended fuel and tend to form stable, flowable suspensions. The vehicle will preferably permit grinding to form primary particles having a median major dimension of less than about 10 microns and to be substantially free of agglomerates. The vehicle will preferably be selected to have dispersant properties, or additives can be employed to achieve this effect. If the chosen hydrated compound has a tendency to form agglomerates these can be broken up at the time of introduction into the fuel oil by means of simple low shear equipment such as a static mixer (well known in the art). Large agglomerates may not be fully dehydrated at a rapid enough rate to provide the optimum results, and the number of points within the individual atomized droplets where release of gaseous water can take place will be significantly reduced. Conversely, particles of hydrated compound below about 2–3 microns will contain a smaller mass of water and will have less effect in exploding the oil droplet. Thus, the combination of the grinding procedure and the liquid vehicle are important to assurance of proper dispersion in the final fuel treated according to the invention.

Exemplary of suitable vehicles are number 2 fuel oil, toluene, mineral oils of the type employed for lubrication, as well as napthenic oils, aromatic oils, and paraffinic oils, and the like. The vehicle can contain a dispersant such as oleic diethanolamide (DEA), magnesium or sodium petroleum sulfonate, or nonionic surfactants for the solid particulate hydrated compounds. Dispersants, such as oleic DEA and Mg sulfonate, can be employed at a level of from about 0.1% to about 5%.

To achieve a suitably-stable dispersion of the desired particle size and freedom from aggregates, the solid hydrated compounds are admixed with a suitable liquid vehicle and ground or otherwise reduced or pulverized such as in a ball or pin mill or other like device. The vehicle will preferably be employed at a weight percentage of from about 30 to 75%, and the solid hydrated compound at a weight percentage of from about 25 to about 70%. The particle size reduction operation will be continued until the desired particle size and stability is achieved.

The vehicle is preferably substantially free from water because the presence of water can affect long term stability of the suspension unless effective emulsifiers are employed, and it may also dissolve the solid particulate material or cause the agggregation of primary particles to an undesireable degree. Where water is employed in the liquid vehicle, it should not be present to a degree which dissolves so much of the solid hydrated compound that less than the desired amount remains in the solid, hydrated form. Preferably, the hydrated compound and the vehicle together will contain no more free water than 10% of the weight of the hydrated compound.

Once prepared, the fuel additive composition can be stored and transported as needed. It can be blended with any liquid carbonaceous fuel at the desired levels of from about 200 to about 5000, prefereably 500 to 1000, PPM by any suitable equipment, such as a static mixer or in many instances by simply proportional pumping into the fuel line.

Suitable liquid carbonaceous fuels are fuel oils which are liquid at ambient temperature, e.g. number 2, and those which liquify only upon heating, e.g. number 6. The fuels may have no substantial vanadium corrosion potential. Thus, these fuels may either have such low vanadium contents that corrosion is no problem, or will be treated to reduce the corrosion potential. Also included within the meaning of liquid carbonaceous fuels are those liquid hydrocarbons which, while not primarily useful for their value in producing heat upon burning, do have some heat value. Within this group are waste or residue hydrocarbons including creosote, asphalts, and other liquifiable hydrocarbon materials.

In the case of blending the fuel additive with number 6 fuel oil, the oil is preheated to a temperature of at least about 100° C. prior to admixing the additive by conventional fuel oil preheating equipment. Upon atomization of the fuel, thus containing the desired amount of additive, in the combustion zone of a flame burner supplied with sufficient air for combustion, the heat of combustion causes rapid evolution of gaseous water and enhances airfuel mixing turbulence with the enhancement of combustion efficiency as well as a reduction in carbonaceous particulate emissions.

BEST MODE FOR CARRYING OUT THE INVENTION

The following example describes the preparation of a fuel additive, its incorporation into a fuel and the operation of a commercial burner with the fuel as improved according to the invention. The example also compares the operation of the burner with a fuel improved in accordance with the invention to the operation with an unmodified fuel.

EXAMPLE

To prepare the fuel additive, 60 parts by weight of magnesium nitrate hexahydrate were admixed with 39.5 parts by weight of number 2 fuel oil containing 5 parts of oleic DEA and were introduced continuously by recirculation from the mixing tank into a vertical attritor. The hydrate was reduced to achieve a median primary particle size of about 10 microns and was substantially free of aggregates.

The fuel additive so prepared was stored for approximately 1 month at ambient conditions prior to incorporation into fuel oil, but yet showed good flowability and good stability of suspension. To incorporate the additive into number 6 fuel oil, the fuel oil was preheated to a temperature of about 100° C., and the additive was proportionally injected into the oil line ahead of the burners by means of a positive displacement Milton Roy proportioning pump. The mixture of fuel and additive was a substantially homogeneous dispersion of primary particles of hydrate within the fuel oil. The fuel containing the additive was then atomized into a B & W burner of the steam atomized-type at a rate of about 28.2 Tonnes/Hr. Air was supplied at a rate of 400 Tonnes/Hr.

As a control, the same burner was also operated under the same conditions except that the fuel was not treated with the additive according to the invention.

The operating data for the run according to the invention and that according to the comparative run are shown in the table below:

| | | Control | Test |
|---|---|---|---|
| 1. | Treatment | (No Additive) | 12 L/Hr |
| 2. | Load (MW) | 159.9 | 165.8 |
| 3. | Burners in Service | 12 | 12 |
| 4. | Steam Atomizing Pressure (Bars) | 9.7 | 10.5 |
| 5. | % $O_2$ at Economizer Exit | 1.5 | 1.5 |
| 6. | Gas Temperature at Economizer (°C.) | 350° | 360° |
| 7. | HP Feed Water Heaters | In Service | In Service |
| 8. | Total Oil Consumed (Liters) | 243,060 | 251,025 |
| 9. | Total Solids Collected (gm) | 2.6755 | .9363 |
| 10. | Mass Flow Rate of Solids (Kg/H) | 84.31 | 29.51 |
| 11. | Total Flue Gas Solids (Kg) | 505.86 | 177.06 |
| 12. | Solids Burden | 0.229% | .08% |

The above description is for the purpose of teaching the person of ordinary skill in the art how to practice the present invention and is not intended to detail all those obvious modifications and variations of it which will become apparent to the skilled worker upon reading the description. It is intended, however, that all such obvious modifications and variations be included within the scope of the present invention which is defined by the following claims.

What is claimed is:

1. A fuel additive comprising a stable dispersion, in a fuel-miscible liquid vehicle, of finely-divided solid hydrated compound wherein the hydrated compound is selected from the group consisting of transition and alkaline earth metals having an anionic component sufficient to form a hydrated compound which releases its water of hydration at a temperature in excess of about 250° C. and which has a ratio of combined water to total compound weight of greater than 1:5, with the exception of calcium silicate.

2. A fuel additive comprising a stable dispersion, in a fuel-miscible liquid vehicle, of finely-divided hydrated compound comprising a nitrate or acetate of an alkaline earth or transition metal.

3. A fuel additive comprising a stable dispersion, in a fuel-miscible liquid vehicle, of finely-divided hydrated compound comprising a nitrate, acetate or silicate of magnesium, manganese, aluminum, or cobalt.

4. A fuel additive according to any of claims 1–3 which is substantially without an excess of free water and containing only that water present in the hydrated compound.

5. A fuel additive according to any of claims 1–3 wherein the liquid vehicle comprises number 2 fuel oil.

6. A fuel additive according to any of claims 1–3 which includes a catalytically effective amount, based on the weight of the hydrated compound, of a catalytic compound containing a platinum group metal.

7. A fuel additive according to any of claims 1–3 wherein the hydrated compound rapidly releases its water of hydration at a temperature within the range of from 250° to 300° C.

8. A fuel additive according to any of claims 1–3 wherein the median major dimensions of primary particles of the hydrated compound is less than about 10 microns and greater than about 2 microns.

9. A fuel additive according to claim 8 wherein the hydrated compound comprises magnesium nitrate hexahydrate or magnesium nitrate heptahydrate.

10. A fuel additive according to claim 8 wherein the ratio of combined water to total compound weight is greater than 1:4.

11. A fuel additive according to claim 10 wherein said ratio is greater than 1:3.

12. A fuel composition comprising a liquid carbonaceous fuel and an additive according to any of claims 1–3 wherein said additive comprises from about 50 PPM to about 5000 PPM by weight of said fuel.

13. A fuel composition according to claim 12 wherein the hydrated compound has a ratio of combined water to total compound weight of greater than one to four.

14. A fuel composition according to claim 12 wherein the hydrated compound contained therein comprises from about 50 PPM to about 3750 PPM by weight of the fuel.

15. A fuel composition according to claim 12 which is substantially without an excess of free water and containing only that water present in the hydrated compound.

16. A fuel composition according to claim 12 wherein the liquid vehicle for the additive contained therein comprises number 2 fuel oil.

17. A fuel composition according to claim 12 wherein the median major dimension of primary particles of the hydrated compound is less than about 10 microns.

18. A fuel composition according to claim 12 which includes a catalytically effective amount, based on the weight of the hydrated compound, of a catalytic compound containing a platinum group metal.

19. A fuel composition according to claim 12 wherein the hydrated compound rapidly releases its water of hydration at a temperature within the range of from 250° to 500° C.

20. A fuel composition according to claim 12 wherein the liquid carbonaceous fuel comprises fuel oil.

21. A fuel composition according to claim 20 wherein the liquid carbonaceous fuel comprises fuel oil of grade No. 5 or No. 6.

22. A method of preparing a fuel additive according to any one of claims 1–3 which comprises admixing a solid hydrated compound with a liquid vehicle in which the solid is substantially insoluble and reducing the particle size of said solid sufficiently to form a stable suspension.

23. An improved method of combustion comprising admixing an additive according to any one of claims 1–3 with a liquid carbonaceous fuel wherein said additive comprises from about 50 PPM to about 5000 PPM by weight of said fuel, and atomizing said fuel with air into a combustion zone operated at a temperature of above about 1350° C. to effect combustion of said fuel.

* * * * *